US011688344B2

(12) United States Patent
Shin et al.

(10) Patent No.: US 11,688,344 B2
(45) Date of Patent: Jun. 27, 2023

(54) DISPLAY DEVICE AND DRIVING METHOD OF THE SAME

(71) Applicant: SAMSUNG DISPLAY CO., LTD., Yongin-si (KR)

(72) Inventors: Yong Jin Shin, Yongin-si (KR); Min Soo Kang, Yongin-si (KR); Nag Joon Kim, Yongin-si (KR); Byoung Chel Kim, Yongin-si (KR); Yeon Sung Kim, Yongin-si (KR); Hyoung Rae Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/672,065

(22) Filed: Feb. 15, 2022

(65) Prior Publication Data

US 2022/0262311 A1 Aug. 18, 2022

(30) Foreign Application Priority Data

Feb. 18, 2021 (KR) ..... 10-2021-0022175

(51) Int. Cl.
*G09G 3/32* (2016.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2310/08* (2013.01)

(58) Field of Classification Search
CPC ..... G09G 3/32; G09G 3/3225; G09G 3/3233; G09G 3/3283; G09G 3/3291;
(Continued)

(56) References Cited

U.S. PATENT DOCUMENTS 10,032,410 B2 7/2018 Takasugi et al.
2015/0294626 A1* 10/2015 Bi ..... G09G 3/3233 345/82
(Continued)

FOREIGN PATENT DOCUMENTS

KR 1020160007876 A 1/2016
KR 1020170081056 A 7/2017
(Continued)

*Primary Examiner* — Michael J Eurice
(74) *Attorney, Agent, or Firm* — Cantor Colburn LLP

(57) ABSTRACT

A display device includes: a pixel including a light emitting element and a first transistor for applying a driving current to the light emitting element; a data driver for supplying a first data voltage corresponding to first sensing data to the pixel in a sensing period, and supplying, to the pixel, a second data voltage corresponding to second sensing data or a third data voltage corresponding to third sensing data in a verification period for detecting compensation degree of the sensing period; a sensing unit for extracting a first sensing value corresponding to the first sensing data, a second sensing value corresponding to the second sensing data, and a third sensing value corresponding to the third sensing data through sensing lines; and a timing controller for generating image data compensated using the first sensing value, and detecting the compensation degree using the second sensing value or the third sensing value.

14 Claims, 7 Drawing Sheets

(58) Field of Classification Search
CPC ... G09G 2300/0819; G09G 2300/0842; G09G 2300/0861; G09G 2310/0251; G09G 2310/027; G09G 2310/08; G09G 2320/0233; G09G 2320/0285; G09G 2320/0295; G09G 2320/043; G09G 2320/045; G09G 2360/16
See application file for complete search history.

(56) References Cited

U.S. PATENT DOCUMENTS

| | | | | |
|---|---|---|---|---|
| 2015/0379923 | A1* | 12/2015 | Lee | H01L 27/3272 345/82 |
| 2020/0184886 | A1* | 6/2020 | Chun | G09G 3/3291 |
| 2020/0335045 | A1 | 10/2020 | Jeong et al. | |
| 2021/0158754 | A1* | 5/2021 | Umezawa | G09G 3/3275 |

FOREIGN PATENT DOCUMENTS

| | | | | |
|---|---|---|---|---|
| KR | 1020190021757 | A | 3/2019 | |
| KR | 1020190075325 | A | 7/2019 | |
| KR | 102164157 | B1 | 10/2020 | |
| KR | 1020200123694 | A | 10/2020 | |
| WO | WO-2022070386 | A1 * | 4/2022 | G09G 3/3233 |

* cited by examiner

DISPLAY DEVICE AND DRIVING METHOD OF THE SAME

The present application claims priority to Korean patent application 10-2021-0022175 filed on Feb. 18, 2021, and all the benefits accruing therefrom under 35 U.S.C. § 119, the content of which in its entirety is herein incorporated by reference.

BACKGROUND

1. Technical Field

The present disclosure generally relates to a display device and a driving method of the same.

2. Related Art

With the development of information technologies, the importance of a display device which is a connection medium between a user and information increases. Accordingly, the display device such as a liquid crystal display device and an organic light emitting display device is increasingly used.

The display device includes pixels, and each of the pixels includes a light emitting element and a driving transistor for supplying a driving current to the light emitting element. Each of the pixels may be degraded. For example, the threshold voltage and mobility of the driving transistor may be changed according to time, and the light emitting element may be degraded. In order to compensate for the degradation of the pixels, a technique for sensing characteristic information of each pixel (i.e., the driving transistor and the light emitting element) through an external compensation circuit has been used.

SUMMARY

Embodiments provide a display device and a driving method thereof, which can improve the image quality of a display by increasing the accuracy of external compensation.

Embodiments also provide a display device and a driving method of the same, which can check compensation accuracy after external compensation.

In accordance with an aspect of the present disclosure, there is provided a display device including: pixels each including at least one light emitting element and a first transistor for applying a driving current to the light emitting element; a data driver which supplies a first data voltage corresponding to first sensing data to at least one pixel of the pixels in a sensing period, and supplies, to the at least one pixel, a second data voltage corresponding to second sensing data different from the first sensing data or a third data voltage corresponding to third sensing data, in a verification period for detecting a compensation degree of the sensing period; a sensing unit which extracts a first sensing value corresponding to the first sensing data, a second sensing value corresponding to the second sensing data, and a third sensing value corresponding to the third sensing data through sensing lines connected to the at least one pixel; and a timing controller which generates image data compensated by using the first sensing value, and detects the compensation degree by using the second sensing value or the third sensing value.

The sensing unit may supply an initialization voltage to the sensing lines during a partial period in the sensing period.

The verification period may include a first verification period and a second verification period. In the first verification period, the data driver may supply, to the at least one pixel, a voltage obtained by adding the initialization voltage and a threshold voltage, where the threshold voltage may be included in the first sensing value, and the obtained voltage may correspond to the second sensing data.

The sensing unit may extract a current value of a second driving current included in the second sensing value. The timing controller may determine whether the current value of the second driving current is 0.

In the second verification period, the data driver may supply the initialization voltage corresponding to the third sensing data to the at least one pixel.

The sensing unit may extract a current value of a third driving current included in the third sensing value. The timing controller may detect the compensation degree by using a ratio of the current value of the third driving current and a current value of a first driving current, where the first driving current is included in the first sensing value.

The timing controller may determine whether the ratio is greater than or equal to a predetermined ratio, and provide the data driver with the image data compensated by using the first sensing value, when the ratio is greater than or equal to the predetermined ratio.

When the ratio is greater than or equal to the predetermined ratio, the data driver may supply the first data voltage corresponding to the compensated image data to the at least one pixel.

The first transistor may include a gate electrode connected to a first node and be connected between a first power line to which a first driving voltage is applied and a second node. Each of the pixels may include: a second transistor connected between a data line and the gate electrode of the first transistor, where the second transistor includes a gate electrode connected to a first scan line; a third transistor connected between a sensing line and the second node, where the third transistor includes a gate electrode connected to a second scan line; a fourth transistor connected between the second node and the light emitting element, where the fourth transistor includes a gate electrode connected to an emission control line; and a switching capacitor connected to the gate electrode of the first transistor and the second node.

The sensing unit may extract the threshold voltage by using a voltage of the second node and the first data voltage in the sensing period.

In accordance with an aspect of the present disclosure, there is to provided a method for driving a display device including pixels, a data driver, a sensing unit, and a timing controller, the method including: applying, by a first transistor, a driving current to at least one light emitting element, wherein each of the pixels includes the light emitting element and the first transistor; supplying, by the data driver, a first data voltage corresponding to first sensing data to at least one pixel of the pixels during a sensing period, and supplying, to the at least one pixel, a second data voltage corresponding to second sensing data different from the first sensing data or a third data voltage corresponding to third sensing data, in a verification period for detecting a compensation degree of the sensing period; extracting, by the sensing unit, a first sensing value corresponding to the first sensing data, a second sensing value corresponding to the second sensing data, and a third sensing value corresponding to the third sensing data through sensing lines connected to the at least one pixel; and generating, by the timing controller, image data compensated by using the first sensing value, and detecting the compensation degree by using the second sensing value or the third sensing value.

The extracting of, by the sensing unit, the first sensing value may include supplying an initialization voltage to the sensing lines during a partial period in the sensing period.

The verification period may include a first verification period and a second verification period. The supplying of, by the data driver, the second data voltage may include supplying, by the data driver, to the at least one pixel, a voltage obtained by adding the initialization voltage and a threshold voltage, where the threshold voltage may be included in the first sensing value, and the obtained voltage may correspond to the second sensing data.

The extracting of, by the sensing unit, the second sensing value may include extracting, by the sensing unit, a current value of a second driving current included in the second sensing value. The detecting of, by the timing controller, the compensation degree by using the second sensing value may include determining, by the timing controller, whether the current value of the second driving current is 0.

The supplying of, by the data driver, the third data voltage may include supplying, by the data driver, the initialization voltage corresponding to the third sensing data to the at least one pixel in the second verification period.

The extracting of, by the sensing unit, the third sensing value may include extracting, by the sensing unit, a current value of a third driving current included in the third sensing value. The detecting of, by the timing controller, the compensation degree by using the second sensing value may include detecting, by the timing controller, the compensation degree by using a ratio of the current value of the third driving current and a current value of a first driving current, where first driving current may be included in the first sensing value.

The detecting of, by the timing controller, the compensation degree by using the second sensing value may include determining, by the timing controller, whether the ratio is greater than or equal to a predetermined ratio, and providing the data driver with the image data compensated by using the first sensing value, when the ratio is greater than or equal to the predetermined ratio.

The method may include supplying, by the data driver, the first data voltage corresponding to the compensated image data to the at least one pixel, when the ratio is greater than or equal to the predetermined ratio.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
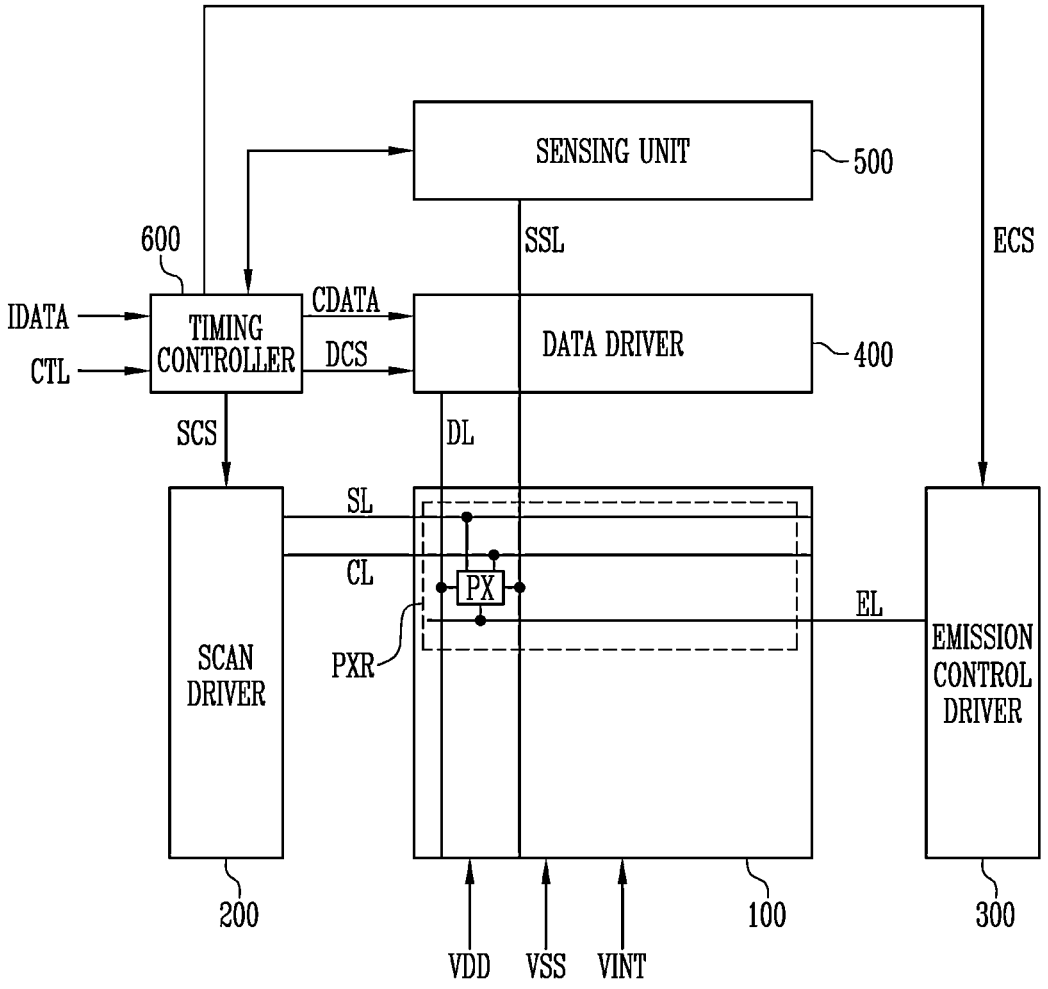
FIG. 1 is a block diagram schematically illustrating a display device in accordance with an embodiment of the present disclosure.

Hereinafter, embodiments will be described in detail with reference to the accompanying drawings. The effects and characteristics of the present disclosure and a method of achieving the effects and characteristics will be clear by referring to the embodiments described below in detail together with the accompanying drawings. However, the present disclosure is not limited to the embodiments disclosed herein but may be implemented in various forms. The embodiments are provided by way of example only so that a person of ordinary skilled in the art can fully understand the features in the present disclosure and the scope thereof. Therefore, the present disclosure can be defined by the scope of the appended claims. Like reference numerals generally denote like elements throughout the specification.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. As used herein, the singular forms are intended to include the plural forms as well, unless the context clearly indicates otherwise.

FIG. 1 is a block diagram schematically illustrating a display device in accordance with an embodiment of the present disclosure.

Referring to FIG. 1, the display device in accordance with the embodiment of the present disclosure may include a display 100, a scan driver 200, an emission control driver 300, a data driver 400, a sensing unit 500, and a timing controller 600.

The display device may be a flat panel display device, a flexible display device, a curved display device, a foldable display device, a bendable display device, or a stretchable display device. Also, the display device may be applied to a head-mounted display device, a wearable display device, or the like. Also, the display device may be applied to various electronic devices including a smartphone, a tablet, a smart pad, a TV, a monitor, or the like.

The display device may be implemented as a self-luminous display device including a plurality of self-luminous elements. For example, the display device may be a display device including organic light emitting elements, a display device including inorganic light emitting elements, or a display device including light emitting elements made of a combination of inorganic and organic materials. However, this is merely illustrative, and the display device may be implemented as a quantum dot display device, or the like.

In an embodiment, the display device may be driven in a frame which is divided into a data write period in which a data voltage is written in pixels PX to display an image, an emission period in which light emitting elements emit light, a sensing period for sensing a characteristic of a driving transistor included in each of the pixels PX, a verification period for verifying a sensing value (e.g., the characteristic of the driving transistor) sensed in the sensing period, or the like.

The display 100 includes a pixel PX connected to a data line DL, a first scan line SL, a second scan line CL, an emission control line EL, and a sensing line SSL. The display 100 may include a plurality of pixels PX connected to a plurality of data lines DL, a plurality of first scan lines SL, a plurality of second scan lines CL, a plurality of emission control lines EL, and a plurality of sensing lines SSL, respectively.

The plurality of pixels PX may be divided into pixel rows PXR arranged in a horizontal direction, and the display 100 may include a plurality of pixel rows PXR. Here, the pixel row PXR means a group of pixels PX in the same row.

The pixel PX may be supplied with a first driving voltage VDD, a second driving voltage VSS, and an initialization voltage VINT from the outside. A detailed structure of the pixel PX will be described below in FIG. 2.

The scan driver 200 receives a scan control signal SCS from the timing controller 600. The scan driver 200 may supply a first scan signal to each of the first scan lines SL in response to the scan control signal SCS, and supply a second signal to each of the second scan lines CL.

The scan driver 200 may sequentially supply the first scan signal to the first scan lines SL. For example, the first scan signal may be set to a gate-on voltage such that a transistor included in the pixel PX can be turned on. Also, the first scan signal may be used to apply a data signal (or data voltage) to the pixel PX.

Also, the scan driver 200 may supply the second scan signal to the second scan lines CL. For example, the second scan signal may be set to the gate-on voltage such that the transistor included in the pixel PX can be turned on. The second scan signal may be used to sense (or extract) a driving current flowing through the pixel PX or to apply the initialization voltage VINT to the pixel PX.

Although a case where one scan driver 200 outputs both the first scan signal and the second scan signal is illustrated in FIG. 1, the present disclosure according to the invention is not limited thereto. In some embodiments, the scan driver 200 may include a first scan driver (not shown) for supplying the first scan signal to the display 100 and a second scan driver (not shown) for supplying the second scan signal to the display 100. That is, the first scan driver and the second scan driver may be implemented as components separate from each other.

The emission control driver 300 receives an emission control signal ECS from the timing controller 600. The emission control driver 300 may supply an emission signal to the emission control signals EL in response to the emission control signal ECS.

The emission control driver 300 may supply the emission signal to each of the emission control lines EL. For example, the emission signal may be set to the gate-on voltage such that the transistor included in the pixel PX can be turned on. Also, the emission signal may be used to allow a light emitting element included in the pixel PX to emit light.

The data driver 400 receives a data control signal DCS from the timing controller 600. During a data write period, the data driver 400 may supply a data signal (or data voltage) for displaying an image to the display 100, based on compensated image data CDATA. Also, during a sensing period, the data driver 400 may supply, to the display 100, a data signal (e.g., a sensing signal) for detecting a characteristic of the pixel PX. Also, during a verification period (e.g., a first verification period or a second verification period), the data driver 400 may supply, to the display 100, a data signal (e.g., a verify signal) for detecting a compensation degree of the compensated image data CDATA.

The sensing unit 500 may calculate a specific value of the pixels PX, based on sensing values provided from the sensing lines SSL, and generate a compensation value for compensating for characteristic values of the pixels PX. For example, the sensing unit 500 may detect and compensate for a threshold voltage Vth (See FIG. 3A) change of the driving transistor (e.g., T1 in FIG. 2) included in the pixel PX, a mobility change of the driving transistor, a characteristic change of the light emitting element, or the like.

In an embodiment, during the data write period, the sensing unit 500 may supply a predetermined initialization voltage VINT for displaying an image to the display 100 through the sensing lines SSL. Also, during the sensing period, the sensing unit 500 may receive a current or voltage extracted from the pixel PX through the sensing lines SSL. The extracted current or voltage may correspond to a sensing value, and the sensing unit 500 may detect a characteristic change of the driving transistor, based on the sensing value.

The sensing unit 500 may calculate a compensation value for compensating for input image data IDATA, based on the detected characteristic change. The compensation value is provided to the timing controller 600, so that the timing controller 600 can generate compensated image data CDATA. In some embodiments, the compensated image data CDATA may be provided to the data driver 400. Also, in some embodiments, the display device may include a separate compensator, and the compensator may receive a sensing value extracted in the sensing unit 500 to generate a compensation value.

The timing controller 600 may receive a control signal CTL and input image data IDATA from an image source such as an external graphic device. The timing controller 600 may generate the data control signal DCS, the scan control signal SCS, and the emission control signal ECS, corresponding to the control signal CT supplied from the outside. The data control signal DCS generated by the timing controller 600 may be supplied to the data driver 400, the scan control signal SCS generated by the timing controller 600 may be supplied to the scan driver 200, and the emission control signal ECS generated by the timing controller 600 may be supplied to the emission control driver 300.

Also, the timing controller 600 may supply compensated image data CDATA to the data driver 400, based on the input image data IDATA supplied from the outside. The input image data IDATA and the compensated image data CDATA may include grayscale information included in a grayscale range set in the display device.

The timing controller 600 may further control an operation of the sensing unit 500. For example, the timing controller 600 may control a timing at which a reference voltage (or initialization voltage VINT) is supplied to the pixels PX through the sensing lines SSL and/or a timing at which a current generated in the pixel PX is sensed through the sensing lines SSL.

Although a case where the sensing unit 500 is a component separate from the timing controller 600 is illustrated in FIG. 1, at least a portion of the sensing unit 500 may be included in the timing controller 600 in another embodiment. For example, the sensing unit 500 and the timing controller 600 may be implemented as one driving integrated circuit. Further, the data driver 400 may also be included in the timing controller 600. Therefore, at least a portion of the data driver 400, the sensing unit 500, and the timing controller 600 may be implemented as one driving integrated circuit in another embodiment.

Figure 3A:
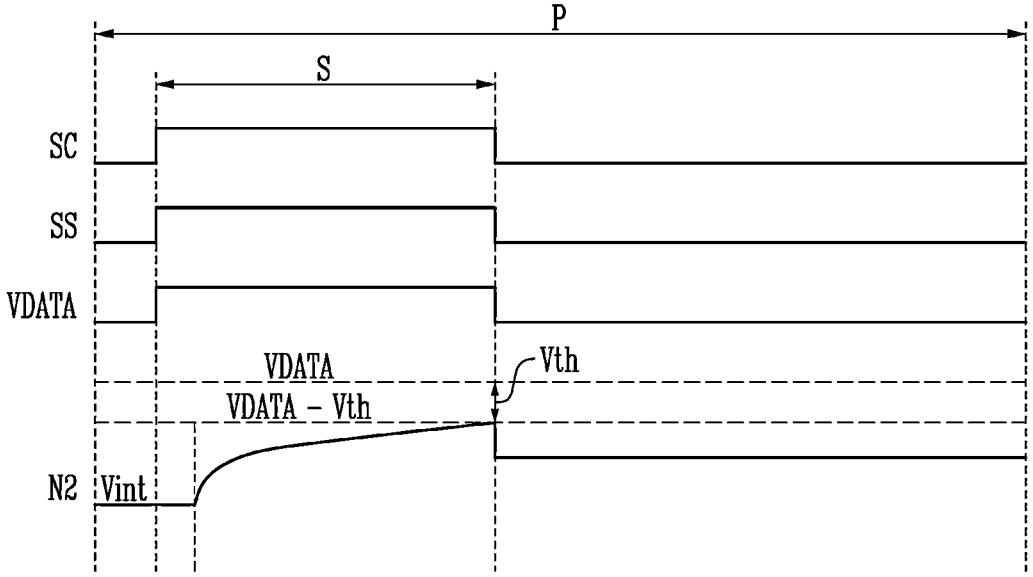
FIG. 3A is a timing diagram illustrating an example of an operation of the pixel shown in FIG. 2 in a sensing period in accordance with an embodiment of the present disclosure.
Figure 3B:
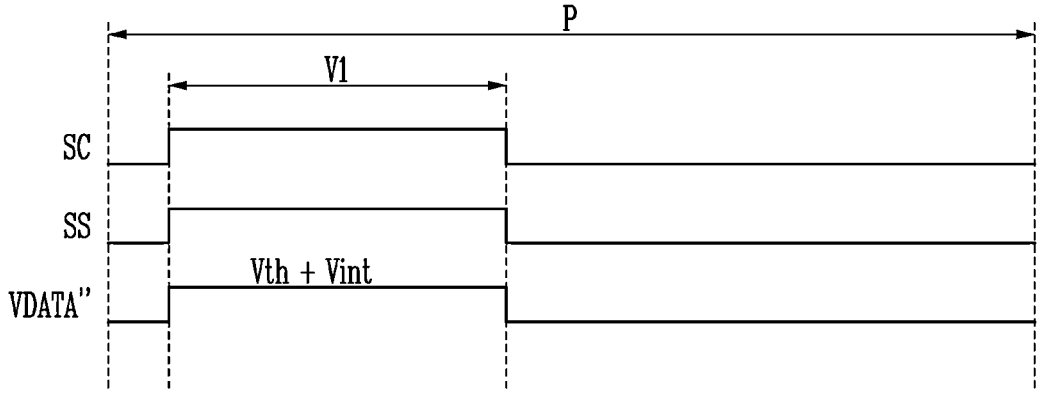
FIG. 3B is a timing diagram illustrating an example of an operation of the pixel shown in FIG. 2 in a first verification period in accordance with an embodiment of the present disclosure.
Figure 3C:
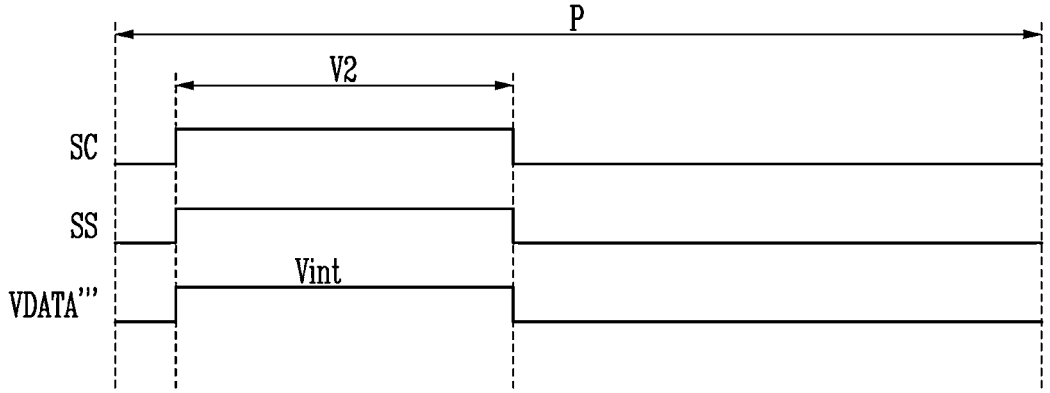
FIG. 3C is a timing diagram illustrating an example of an operation of the pixel shown in FIG. 2 in a second verification period in accordance with an embodiment of the present disclosure.
Figure 4:
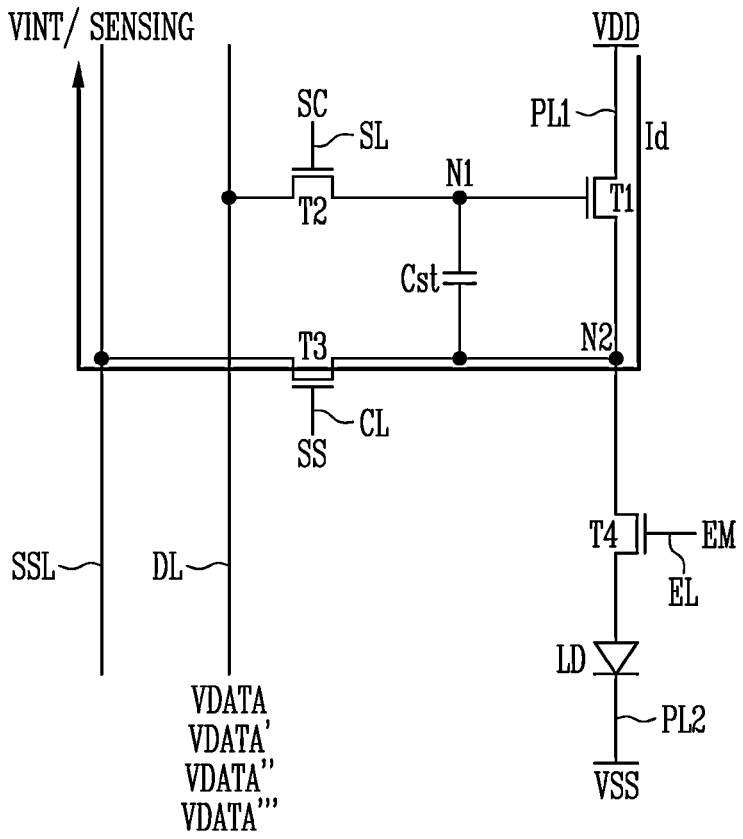
FIG. 4 is a circuit diagram illustrating an example of an operation of the pixel shown in FIG. 2 in the sensing period in accordance with an embodiment of the present disclosure.

Hereinafter, a pixel of the display device in accordance with an embodiment of the present disclosure will be described with reference to FIGS. 2 to 4.

Figure 2:
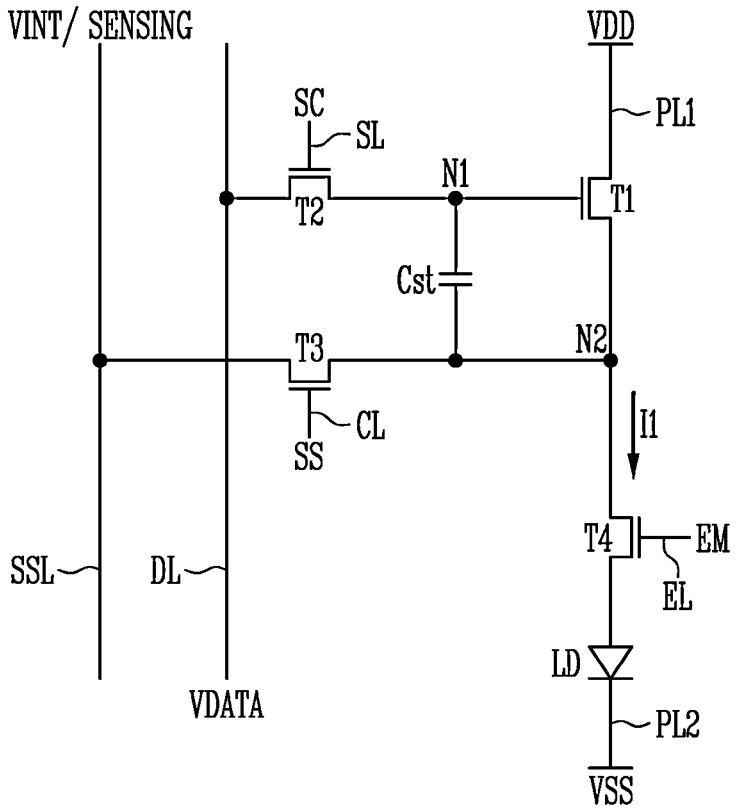
FIG. 2 is a circuit diagram illustrating electrical connection of a pixel in the display device in accordance with an embodiment of the present disclosure.

FIG. 2 is a circuit diagram illustrating electrical connection of a pixel in the display device in accordance with an embodiment of the present disclosure. FIG. 3A is a timing diagram illustrating an example of an operation of the pixel shown in FIG. 2 in a sensing period in accordance with an embodiment of the present disclosure. FIG. 3B is a timing diagram illustrating an example of an operation of the pixel shown in FIG. 2 in a first verification period in accordance with an embodiment of the present disclosure. FIG. 3C is a timing diagram illustrating an example of an operation of the pixel shown in FIG. 2 in a second verification period in accordance with an embodiment of the present disclosure. FIG. 4 is a circuit diagram illustrating an example of an operation of the pixel shown in FIG. 2 in the sensing period in accordance with an embodiment of the present disclosure.

Referring to FIG. 2, the pixel PX may include a light emitting element LD, a first transistor T1, a second transistor T2, a third transistor T3, a fourth transistor T4, and a storage capacitor Cst.

A first electrode of the light emitting element LD may be connected to a second electrode of the fourth transistor T4, and a second electrode of the light emitting element LD may be connected to a second power line PL2. A second driving voltage VSS may be applied to the second electrode of the light emitting element LD through the second power line PL2. The light emitting element LD generates light with a predetermined luminance, corresponding to an amount of a driving current I1 supplied from the first transistor T1. In an embodiment, the first electrode of the light emitting element LD may be an anode, and the second electrode of the light emitting to element LD may be a cathode.

A first electrode of the first transistor T1 (i.e., driving transistor) may be connected to a first power line PL1, and a second electrode of the first transistor T1 may be connected to a second node N2. A gate electrode of the first transistor T1 may be connected to a first node N1. A first driving voltage VDD may be applied to the first electrode of the first transistor T1 through the first power line PL1. The first transistor T1 control the amount of the driving current I1 flowing through the light emitting element LD through the fourth transistor T4, corresponding to a voltage difference between the first node N1 and the second node N2.

A first electrode of the second transistor T2 may be connected to a data line DL, and a second electrode of the second transistor T2 may be connected to the first node N1. A gate electrode of the second transistor T2 may be connected to a first scan line SL. The second transistor T2 may be turned on when a first scan signal SC is supplied to the first scan line SL, to transfer a first data voltage VDATA from the data line DL to the first node N1.

The third transistor T3 may be connected between a sensing line SSL and the second electrode of the first transistor T1 (or the second node N2). A gate electrode of the third transistor T3 may be connected to a second scan line CL. The third transistor T3 may be turned on when a second scan signal SS is supplied to the second scan line CL, to electrically connect the sensing line SSL to the second node N2 (or the second electrode of the first transistor T1).

In an embodiment, when the third transistor T3 is turned on, an initialization voltage VINT may be supplied to the second node N2 through the sensing line SSL. Also, when the third transistor T3 is turned on, the current (driving current I1) generated through the first transistor T1 may be supplied to the sensing unit 500 (see FIG. 1).

A first electrode of the fourth transistor T4 may be connected to the second node N2, and the second electrode of the fourth transistor T4 may be connected to the first electrode of the light emitting element LD. A gate electrode of the fourth transistor T4 may be connected to an emission control line EL. The fourth transistor T4 may be turned on when an emission signal EM is supplied to the emission control line EL, to transfer the driving current I1 applied from the second node N2 to the first electrode of the light emitting element LD.

The storage capacitor Cst may be connected between the first node N1 and the second node N2. During a data write period, the storage capacitor Cst may store a voltage corresponding to a voltage difference between the first data voltage VDATA applied to the first node N1 and the initialization voltage VINT applied to the second node N2.

In the present disclosure, the circuit structure of pixel PX according to the invention is not limited by FIG. 2. In another example, the light emitting element LD may be located between the first power line PL1 and the first electrode of the first transistor T1.

In addition, although a case where the transistors are implemented with an NMOS transistor is illustrated in FIG. 2, the present disclosure according to the invention is not limited thereto. In another example, at least one of the first to fourth transistors T1, T2, T3, and T4 may be implemented with a PMOS transistor.

Hereinafter, a sensing period S, a first verification period V1, and a second verification period V2 of the pixels PX included in the display device in one frame P in accordance with an embodiment of the present disclosure will be described with reference to FIGS. 3A, 3B, and 4.

FIG. 3A mainly illustrates the sensing period S in the one frame P in accordance with an embodiment of the present disclosure.

Specifically, the one frame P may include a sensing period S for sensing a characteristic of the first transistor T1 (i.e., driving transistor) included in the pixel PX.

In some embodiments, during the sensing period S, the sensing unit 500 may receive a sensing current Id (e.g., threshold voltage Vth information of the first transistor T1), which is extracted from the pixel PX through the sensing lines SSL. The sensing current Id of the first transistor T1, which is extracted from the pixel PX, may correspond to a sensing value, and the sensing unit 500 may detect a characteristic change of the first transistor T1, based on the sensing value.

Also, in some embodiments, the sensing unit 500 may calculate a compensation value for compensating for input image data IDATA, based on the detected characteristic change of the first transistor T1, and provide the compensation value to the timing controller 600.

Also, in some embodiments, the timing controller 600 may generate image data CDATA compensated by using the input image data IDATA and the compensation value provided from the sensing unit 500. The compensated image data CDATA may be provided to the data driver 400.

In addition, the data driver 400 may supply a data voltage corresponding to the compensated image data CDATA to the pixels PX included in the display 100. The process is referred to as external compensation.

Specifically, the external compensation will be described with reference to FIGS. 1, 3A, and 4. When the first scan signal SC having a high level is applied to the first scan line SL, the second transistor T2 is turned on. Accordingly, the first data voltage VDATA (corresponding to first sensing data) is applied to the first node N1.

That is, during the sensing period S, the timing controller 600 may supply the first sensing data to the data driver 400. Also, during the sensing period S, the first data voltage VDATA is supplied to the second node N2 included in the pixels PX, and corresponds to the first sensing data supplied to the data driver 400. The first data voltage VDATA may be equally supplied to each of the pixels PX.

When the second scan signal SS having the high level is applied to the second scan line CL, the third transistor T3 is turned on. Accordingly, the initialization voltage VINT as a static voltage transferred from the sensing line SSL is applied to the second node N2. With respect to one horizontal line, the first scan signal SC and the second scan signal SS may be supplied substantially simultaneously. Therefore, a voltage corresponding to a difference between the first data voltage VDATA and the initialization voltage VINT may be stored in the storage capacitor Cst.

Additionally, the initialization voltage VINT supplied from the sensing line SSL is supplied during an initial period in which the second scan signal SS is supplied, and is not supplied in the other period.

The first transistor T1 may control an amount of the sensing current Id of the first transistor T1, corresponding to the voltage stored in the storage capacitor Cst. When the driving current I1 shown in FIG. 2 is supplied together with the sensing current Id shown in FIG. 4 to the sensing unit 500 during the sensing period S, i.e., during the sensing period S, the driving current I1 and the sensing current Id are set as the same current. Hereinafter, both the driving current I1 and the sensing current Id will be described as the driving current I1, except a special case.

The fourth transistor T4 may be set to be in a turn-off state by the emission signal supplied to the emission control line EL.

Then, due to the turn-on of the third transistor T3, the driving current I1 generated through the first transistor T1 is applied to the sensing line SSL. Since the supply of the initialization voltage VINT to the sensing line SSL is suspended, the voltage of the second node N2 may be gradually changed to a voltage higher than the initialization voltage VINT.

The voltage of the second node N2 may increase from the initialization voltage VINT to a difference value (VDATA-Vth) between the first data voltage VDATA and the threshold voltage Vth of the first transistor T1.

Specifically, since the second scan signal SS having the high level is continuously applied to the second scan line CL, the third transistor T3 maintains a turn-on state. The voltage (VDATA-Vth) of the second node N2, which increases to the difference value between the first data voltage VDATA and the threshold voltage Vth of the first transistor T1, may be applied to the sensing lines SSL through the third transistor T3.

The sensing unit 500 may extract the threshold voltage Vth of the first transistor T1 by using the voltage (VDATA-Vth) of the second node N2, which is applied through the sensing lines SSL, and the first data voltage VDATA.

The threshold voltage Vth of the first transistor T1, which the sensing unit 500 extracts by using the voltage (VDATA-Vth) of the second node N2, which is applied through the sensing lines SSL, and the first data voltage VDATA, is shown in the following Equation 1.

$$\text{Threshold voltage } (Vth) = \text{first data voltage } (VDATA) - \text{voltage of second node } (N2) \quad \text{[Equation 1]}$$

In an embodiment, the sensing period S may be a period for sensing a characteristic of the first transistor T1 through the sensing current Id flowing through the first transistor T1.

During the sensing period S, the sensing current Id (or driving current I1) which is generated through the first transistor T1 and then sensed by the sensing unit 500 may correspond to the following Equation 2.

$$I1 = \frac{1}{2} * \text{up} * Cox * \frac{w}{l} * (Vgs - Vth)^2 \quad \text{[Equation 2]}$$

up is an electron mobility, Cox is a gate oxide capacitance per unit width in the first transistor T1, w is a width of the gate electrode of the first transistor T1, I is a length of the gate electrode of the first transistor T1, Vgs is a difference between a voltage of the gate electrode of the first transistor T1 (or the first node N1) and a voltage of the second electrode of the first transistor T1 (or the second node N2), and Vth corresponds to a threshold voltage of the first transistor T1. Vth may be a value sensed in a previous frame.

The sensing unit 500 may calculate a compensation value, based on the extracted threshold voltage Vth of the first transistor T1. The compensation value may be provided to the timing controller 600, to be used as a value for compensating for the pixel PX. That is, the timing controller 600 may generate compensated image data CDATA by using the calculated compensation value, and transfer the compensated image data CDATA to the data driver 400.

Accordingly, during the sensing period S, the sensing unit 500 can detect a characteristic change of the first transistor T1 included in each pixel PX, and calculate a compensation value for compensating for the pixel PX by calculating each compensation value corresponding to the characteristic change. In addition, occurrence of spot and afterimage in the display device can be effectively minimized. That is, when the same data signal is supplied to each pixel PX, a driving current I1 output from the first transistor T1 included in each of the pixels PX can be constantly (or similarly) maintained.

In an embodiment, since the display device is configured to include the sensing period S in a certain period (e.g., at least one of a plurality of frames P), the display device can update, in real time, the characteristic information of the first transistor T1 as the sensing period S is driven. Thus, the display device can effectively minimize the occurrence of spot and afterimage.

Hereinafter, a process will be described, in which the sensing unit 500 calculates a compensation value for compensating for input image data IDATA, based on the detected characteristic change, and the timing controller 600 generates image data CDATA compensated by using the compensation value.

Specifically, the timing controller 600 generates image data CDATA (e.g., corresponding to second data voltage VDATA') compensated by reflecting information on a threshold voltage Vth of the first transistor T1, which is extracted in real time, to input image data IDATA (e.g., corresponding to the first data voltage VDATA), and supplies the generated compensated image data CDATA to the data driver 400.

In addition, the data driver 400 may supply a data signal for displaying an image to the display 100, based on the compensated image data CDATA corresponding to the second data voltage VDATA'.

The difference Vgs between the voltage of the gate electrode of the first transistor T1 (or the first node N1) included in the pixel PX and the voltage of the second electrode of the first transistor T1 (or the second node) may be expressed as second data voltage VDATA'-initialization voltage VINT, and therefore, Equation 2 described above may be modified as the following Equation 3.

$$I1 = \frac{1}{2} * \mathrm{up} * Cox * \frac{w}{l} * ((VDATA' - VINT) - Vth)^2 \quad \text{[Equation 3]}$$

In addition, as described above, the compensated second data voltage VDATA' corresponds to a value obtained by adding the threshold voltage Vth of the first transistor T1, which is extracted in real time in the sensing unit 500, to the first data voltage VDATA, and hence Equation 3 may be modified as the following Equation 4.

$$I1 = \frac{1}{2} * \mathrm{up} * Cox * \frac{w}{l} * ((VDATA + Vth - VINT) - Vth)^2 \quad \text{[Equation 4]}$$

Therefore, finally, the driving current I1 which is generated through the first transistor T1 included in the pixel PX may be expressed as the following Equation 5.

$$I1 = \frac{1}{2} * \mathrm{up} * Cox * \frac{w}{l} * (VDATA - VINT)^2 = \frac{1}{2} * \mathrm{up} * Cox * \frac{w}{l} * (Vgs)^2 \quad \text{[Equation 5]}$$

As can be seen through Equation 5 described above, the sensing unit 500 extracts a threshold voltage Vth of the first transistor T1 through the sensing current Id sensed through the sensing lines SSL, and calculates a compensation value, based on the extracted threshold voltage Vth. The calculated compensation value may be provided to the timing controller 600, to be used as a value for compensating for the pixel PX.

Referring to Equation 5, the driving current I1 which is generated through the first transistor T1 and then applied to the pixels PX is not influenced by the threshold voltage Vth of the first transistor T1 included in the pixel PX. Accordingly, the occurrence of spot and afterimage in the display device can be effectively improved.

In an embodiment, the display device may include one sensing period S in one frame P, but the present disclosure according to the invention is not limited thereto. In some embodiments, the number of sensing periods S may be variously changed.

Additionally, in an embodiment of the present disclosure, a first verification period V1 or second verification period V2 capable of determining a compensation degree of the driving current I1 generated through the first transistor T1 and then finally compensated, which is calculated in Equation 5, may be additionally included.

During the first verification period V1, the timing controller 600 may supply second sensing data (corresponding to the compensated image data CDATA') to the data driver 400.

In addition, a third data voltage VDATA" equally supplied to each of the pixels PX and corresponding to the second sensing data, may correspond to a value obtained by adding the initialization voltage VINT to the threshold voltage Vth of the first transistor T1, which is extracted in the sensing unit 500.

FIG. 3B mainly illustrates the first verification period V1 in the one frame P.

Specifically, the first verification period V1 will be described with reference to FIGS. 3B and 4. The difference Vgs between the voltage of the gate electrode of the first transistor T1 (or the first node N1) included in the pixel PX and the voltage of the second electrode of the first transistor T1 (or the second node) may be expressed as third data voltage VDATA"–initialization voltage VINT, and therefore, Equation 2 described above may be modified as the following Equation 6.

$$I1 = \frac{1}{2} * \mathrm{up} * Cox * \frac{w}{l} * ((VDATA'' - VINT) - Vth)^2 \quad \text{[Equation 6]}$$

In addition, as described above, the third data voltage VDATA" corresponds to a value obtained by adding the threshold voltage Vth of the first transistor T1, which is extracted in real time in the sensing unit 500, to the initialization voltage VINT, and hence Equation 6 may be modified as the following Equation 7.

$$I1 = \frac{1}{2} * up * Cox * \frac{w}{l} * ((VINT + Vth - VINT) - Vth)^2 = 0 \quad \text{[Equation 7]}$$

That is, in an embodiment of the present disclosure, during the first verification period V1, second sensing data corresponding to the third data voltage VDATA" (i.e., the value obtained by adding the initialization voltage VINT to the threshold voltage Vth of the first transistor T1) may be input to the data driver 400.

In addition, the data driver 400 may supply the third data voltage VDATA" corresponding to the second sensing data to the pixels PX included in the display 100.

As described above in Equation 7, the driving current I1 generated through the first transistor T1 included in the pixel PX has a value of 0.

Consequently, when the timing controller 600 applies, to the data driver 400, the second sensing data generated by adding the threshold voltage Vth of the first transistor T1, which is extracted in real time in the sensing unit 500, and the sensing current Id generated through the first transistor T1 and then sensed in the sensing unit 500, which is calculated in Equation 7, has the value of 0, it can be determined that the driving current I1 generated through the first transistor T1 has been compensated enough to minimize the occurrence of spot and afterimage in the display device.

In an embodiment of the present disclosure, a compensation ratio representing a compensation degree may be determined by using the sensing current Id supplied from the first transistor T1, corresponding to the second sensing data.

FIG. 3C mainly illustrates the second verification period V2 in the one frame P.

Specifically, the second verification period V2 will be described with reference to FIGS. 3C and 4. During the second verification period V2, the timing controller 600 may supply third sensing data to the data driver 400. The third sensing data corresponds to the compensated image data CDATA". In addition, a fourth data voltage VDATA'" equally supplied to each of the pixels PX, corresponding to the third sensing data, may correspond to the initialization voltage VINT.

In addition, the data driver 400 may supply a data signal for displaying an image to the display 100, based on the compensated image data CDATA" corresponding to the fourth data voltage VDATA'".

The difference Vgs between the voltage of the gate electrode of the first transistor T1 (or the first node N1) and the voltage of the second electrode of the first transistor T1 (or the second node) may be expressed as "fourth data voltage VDATA'"−initial voltage VINT", and hence Equation 2 described above may be modified as the following Equation 8.

$$I1 = \frac{1}{2} * up * Cox * \frac{w}{l} * ((VDATA''' - VINT) - Vth)^2 = \frac{1}{2} * up * Cox * \frac{w}{l} * ((VINT - VINT) - Vth)^2 \quad \text{[Equation 8]}$$

When Equation 8 is rearranged, Equation 8 may be modified as the following Equation 9.

$$I1 = \frac{1}{2} * up * Cox * \frac{w}{l} * (Vth)^2 \quad \text{[Equation 9]}$$

The timing controller 600 may determine a compensation degree (hereinafter, referred to as "a compensation ratio") of a driving current I1 compensated finally and then generated through the first transistor T1 included in the pixel PX through a ratio of a driving current I1 (hereinafter, referred to as "A") generated through the first transistor T1, which is calculated in Equation 9, and a driving current I1 (hereinafter, referred to as "B") compensated finally and then generated through the first transistor T1, which is calculated in Equation 5. The compensation ratio may be expressed as the following Equation 10.

$$\text{Compensation ratio} = (1-(B/A))*100\% \quad \text{[Equation 10]}$$

As described above in Equation 7, when the timing controller 600 inputs, to the data driver 400, the compensated image data CDATA' generated by adding the threshold voltage Vth of the first transistor T1 to the initialization voltage VINT, B has the value of 0. Here, the threshold voltage Vth is extracted in real time in the sensing unit 500.

In addition, the compensation ratio calculated in Equation 10 corresponds to 100 percentages (%), and it can be determined that, as the compensation ratio calculated in Equation 10 becomes closer to 100%, the driving current I1 compensated finally and then generated through the first transistor T1 has been compensated enough to minimize the occurrence of spot and afterimage in the display device.

Also, when the compensation ratio calculated in Equation 10 is greater than or equal to a predetermined compensation ratio, it can be determined that the driving current I1 compensated finally and then generated through the first transistor T1, which is calculated in Equation 5, has been compensated enough to minimize the occurrence of spot and afterimage in the display device.

That is, when the compensation ratio calculated in Equation 10 is greater than or equal to the predetermined compensation ratio, the timing controller 600 inputs, to the data driver 400, compensated image data CDATA generated by adding the threshold voltage Vth of the first transistor T1, which is extracted in real time, to the first data voltage VDATA corresponding to the input image data IDATA.

In addition, the data driver 400 supplies a data signal for displaying an image to the display 100, based on the compensated image data CDATA corresponding to the second data voltage VDATA, and thus the occurrence of spot and afterimage in the display device can be effectively minimized.

Hereinafter, a driving method of the display device in accordance with an embodiment of the present disclosure will be described in detail with reference to FIG. 5.

Figure 5:
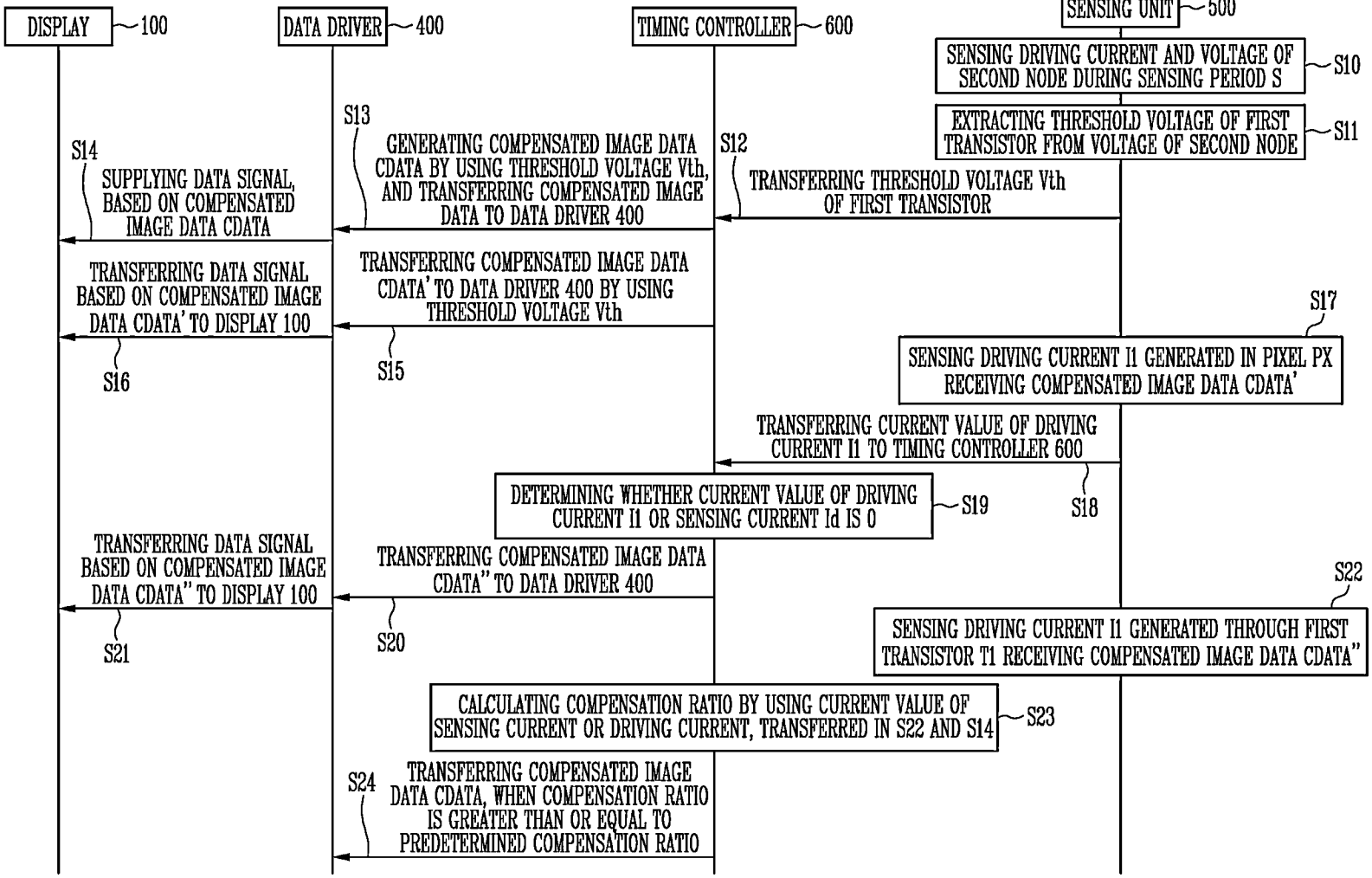
FIG. 5 is a diagram illustrating a driving method of the display device in accordance with an embodiment of the present disclosure.

FIG. 5 is a diagram illustrating a driving method of the display device in accordance with an embodiment of the present disclosure.

In step S10, the sensing unit 500 may receive a driving current I1 extracted from the pixel PX through the sensing lines SSL or a voltage of the second node N2 during the sensing period S.

Specifically, during the sensing period S, the first scan signal SC having the high level is applied to the first scan line SL, and the second scan signal SS having the high level is applied to the second scan line CL. Therefore, the second transistor T2 and the third transistor T3 are turned on.

In addition, due to the turn-on of the third transistor T3, the driving current I1 generated through the first transistor T1 is to applied to the sensing line SSL. Since the supply of the initialization voltage VINT to the sensing line SSL is suspended, the voltage of the second node N2 is increased to a voltage higher than the initialization voltage VINT.

The voltage of the second node N2 may increase from the initialization voltage VINT to a difference (VDATA-Vth) between the first data voltage VDATA and the threshold voltage Vth of the first transistor T1.

Also, the voltage of the second node N2 is applied to the sensing lines SSL through the third transistor T3, and is applied to the sensing unit 500 through the sensing lines SSL.

In addition, since the second scan signal SS having the high level is continuously applied to the second scan line CL, the third transistor T3 is maintained to be in the turn-on state. The driving current I1 generated through the first transistor T1 is applied to the sensing lines SSL through the second node N2 and the third transistor T3, and is applied to the sensing unit 500 through the sensing lines SSL.

In step S11, the sensing unit 500 extracts a threshold voltage Vth of the first transistor T1 from the voltage of the second node N2, which is applied through the sensing lines SSL.

Specifically, the sensing unit 500 may extract the threshold voltage Vth of the first transistor T1 by using the voltage at the second node N2, which is applied through the sensing lines SSL, and first data voltage VDATA input through the data line DL.

In step S12, the sensing unit 500 transfers the extracted threshold voltage Vth of the first transistor T1 to the timing controller 600.

In step S13, the timing controller 600 inputs, to the data driver 400, image data CDATA compensated by using the transferred threshold voltage Vth.

Specifically, the timing controller 600 inputs, to the data driver 400, compensated image data CDATA (corresponding to second voltage VDATA' generated by adding the threshold voltage Vth of the first transistor T1 to first data voltage VDATA corresponding to input image data IDATA, Here, the threshold voltage Vth is extracted in real time from each of a plurality of pixels PX.).

In step S14, the data driver 400 supplies a data signal for displaying an image to the display 100, based on the compensated image data CDATA corresponding to a second data voltage VDATA'.

In step S15, the timing controller 600 inputs, to the data driver 400, image data CDATA' compensated by using the threshold voltage Vth transferred in the step S12.

Specifically, the timing controller 600 inputs, to the data driver 400, compensated image data CDATA' corresponding to a third data voltage VDATA" generated by the threshold voltage Vth of the first transistor T1, which is extracted in real time from each of the plurality of pixels PX, to the initialization voltage VINT.

In step S16, the data driver 400 supplies a data signal for displaying an image to the display 100, based on the compensated image data CDATA' corresponding to the third data voltage VDATA".

In step S17, the sensing unit 500 senses a driving current I1 generated through the first transistor T1 included in the pixel receiving the compensated image data CDATA' through the sensing lines SSL.

In step S18, the sensing unit 500 transfers, to the timing controller 600, the driving current I1 of the first transistor T1, which is sensed in the step S17, i.e., a current value of a sensing current Id.

In step S19, the timing controller 600 determines whether the current value of the sensing current Id, which is transferred by the sensing unit 500 in the step S18, is 0.

In step S20, the timing controller 600 inputs, to the data driver 400, image data CDATA" compensated by using the threshold voltage Vth transferred in the step S12.

In step S21, the data driver 400 supplies a data signal for displaying an image to the display 100, based on the compensated image data CDATA" corresponding to a fourth data voltage VDATA'".

In step S22, the sensing unit 500 senses the driving current I1 generated through the first transistor T1 included in the pixel PX receiving the compensated image data CDATA" through the sensing lines SSL.

In step S23, the timing controller 600 calculates a compensation ratio by using a current value of the sensing current Id sensed by the sensing unit 500 in the step S22 and a current value of the sensing current Id transferred by the sensing unit 500 in the step S14.

In step S24, when the calculated compensation ratio is greater than or equal to a predetermined compensation ratio, the timing controller 600 transfers, to the data driver 400, image data CDATA (corresponding to the second data voltage VDATA') compensated by using the threshold voltage Vth input in the step S12.

In the display device and the driving method of the same in accordance with the present disclosure, the image quality of the display can be improved by increasing the accuracy of external compensation.

Also, in the display device and the driving method of the same in accordance with the present disclosure, the sensing accuracy for sensing characteristic information of the pixels of the display can be increased so as to achieve external compensation.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

pixels each including at least one light emitting element and a first transistor for applying a driving current to the light emitting element;

a data driver which supplies a first data voltage corresponding to first sensing data to at least one pixel of the pixels in a sensing period, and supplies, to the at least one pixel, a second data voltage corresponding to second sensing data different from the first sensing data or a third data voltage corresponding to third sensing data in a verification period for detecting a compensation degree of the sensing period;

a sensing unit which extracts a first sensing value corresponding to the first sensing data, a second sensing value corresponding to the second sensing data, and a third sensing value corresponding to the third sensing data through sensing lines connected to the at least one pixel; and a timing controller which generates image data compensated by using the first sensing value, and detects the compensation degree by using the second sensing value or the third sensing value, wherein the sensing unit supplies an initialization voltage to the sensing lines during a partial period in the sensing period, wherein the verification period includes a first verification period, wherein, in the first verification period, the data driver supplies, to the at least one pixel, a voltage obtained by adding the initialization voltage and a threshold voltage, and wherein the threshold voltage is included in the first sensing value, and the obtained voltage corresponds to the second sensing data.

2. The display device of claim 1, wherein the sensing unit extracts a current value of a second driving current included in the second sensing value, and wherein the timing controller determines whether the current value of the second driving current is 0.

3. The display device of claim 1, wherein the verification period further includes a second verification period, wherein, in the second verification period, the data driver supplies the initialization voltage corresponding to the third sensing data to the at least one pixel.

4. The display device of claim 3, wherein the sensing unit extracts a current value of a third driving current included in the third sensing value, wherein the timing controller detects the compensation degree by using a ratio of the current value of the third driving current and a current value of a first driving current, and wherein the first driving current is included in the first sensing value.

5. The display device of claim 4, wherein the timing controller determines whether the ratio is greater than or equal to a predetermined ratio, and provides the data driver with the image data compensated by using the first sensing value, when the ratio is greater than or equal to the predetermined ratio.

6. The display device of claim 5, wherein, when the ratio is greater than or equal to the predetermined ratio, the data driver supplies the first data voltage corresponding to the compensated image data to the at least one pixel.

7. The display device of claim 6, wherein the first transistor includes a gate electrode connected to a first node and is connected between a first power line to which a first driving voltage is applied and a second node, and wherein each of the pixels includes:

a second transistor connected between a data line and the gate electrode of the first transistor, the second transistor including a gate electrode connected to a first scan line;

a third transistor connected between a sensing line and the second node, the third transistor including a gate electrode connected to a second scan line;

a fourth transistor connected between the second node and the light emitting element, the fourth transistor including a gate electrode connected to an emission control line; and a switching capacitor connected to the gate electrode of the first transistor and the second node.

8. The display device of claim 7, wherein the sensing unit extracts the threshold voltage by using a voltage of the second node and the first data voltage in the sensing period.

9. A method for driving a display device including pixels, a data driver, a sensing unit, and a timing controller, the method comprising:

applying, by a first transistor, a driving current to at least one light emitting element, wherein each of the pixels includes the light emitting element and the first transistor;

supplying, by the data driver, a first data voltage corresponding to first sensing data to at least one pixel of the pixels during a sensing period, and supplying, to the at least one pixel, a second data voltage corresponding to second sensing data different from the first sensing data or a third data voltage corresponding to third sensing data, in a verification period for detecting a compensation degree of the sensing period;

extracting, by the sensing unit, a first sensing value corresponding to the first sensing data, a second sensing value corresponding to the second sensing data, and a third sensing value corresponding to the third sensing data through sensing lines connected to the at least one pixel; and generating, by the timing controller, image data compensated by using the first sensing value, and detecting the compensation degree by using the second sensing value or the third sensing value, wherein the extracting of, by the sensing unit, the first sensing value includes supplying an initializing voltage to the sensing lines during a partial period in the sensing period, wherein the verification period includes a first verification period, wherein the supplying of, by the data driver, the second data voltage includes supplying, by the data driver, to the at least one pixel, a voltage obtained by adding the initialization voltage and a threshold voltage, and wherein the threshold voltage is included in the first sensing value, and the obtained voltage corresponds to the second sensing data.

10. The method of claim 9, wherein the extracting of, by the sensing unit, the second sensing value includes extracting, by the sensing unit, a current value of a second driving current included in the second sensing value, and wherein the detecting of, by the timing controller, the compensation degree by using the second sensing value includes determining, by the timing controller, whether the current value of the second driving current is 0.

11. The method of claim 9, wherein the verification period further includes a second verification period, wherein the supplying of, by the data driver, the third data voltage includes supplying, by the data driver, the initialization voltage corresponding to the third sensing data to the at least one pixel in the second verification period.

12. The method of claim 11, wherein the extracting of, by the sensing unit, the third sensing value includes extracting, by the sensing unit, a current value of a third driving current included in the third sensing value, wherein the detecting of, by the timing controller, the compensation degree by using the second sensing value includes detecting, by the timing controller, the compensation degree by using a ratio of the current value of the third driving current and a current value of a first driving current, and wherein the first driving current is included in the first sensing value.

13. The method of claim 12, wherein the detecting of, by the timing controller, the compensation degree by using the second sensing value includes determining, by the timing controller, whether the ratio is greater than or equal to a predetermined ratio, and providing the data driver with the image data compensated by using the first sensing value, when the ratio is greater than or equal to the predetermined ratio.

14. The method of claim 13, comprising supplying, by the data driver, the first data voltage corresponding to the compensated image data to the at least one pixel, when the ratio is greater than or equal to the predetermined ratio.

* * * * *